US008469533B2

(12) United States Patent
Shen

(10) Patent No.: US 8,469,533 B2
(45) Date of Patent: Jun. 25, 2013

(54) WATER-COOLING HEAT DISSIPATION SYSTEM FOR LED SIGNBOARD

(75) Inventor: Ching-Hang Shen, Sinjhuang (TW)

(73) Assignee: Beijing AVC Technology Research Center Co., Ltd., Beijing (CN)

( * ) Notice: Subject to any disclaimer, the term of this patent is extended or adjusted under 35 U.S.C. 154(b) by 618 days.

(21) Appl. No.: 12/700,735

(22) Filed: Feb. 5, 2010

(65) Prior Publication Data

US 2011/0192571 A1 Aug. 11, 2011

(51) Int. Cl.
*F21V 21/00* (2006.01)
*F21V 29/00* (2006.01)

(52) U.S. Cl.
USPC ..... 362/97.1; 362/249.02; 362/373

(58) Field of Classification Search
USPC ..... 362/97.1–97.4, 249.02, 373
See application file for complete search history.

(56) References Cited

U.S. PATENT DOCUMENTS

2006/0245214 A1* 11/2006 Kim ..... 362/632
2007/0001582 A1* 1/2007 Shin et al. ..... 313/498
2008/0130289 A1 6/2008 Takemoto et al.

* cited by examiner

*Primary Examiner* — Sean Gramling

(57) ABSTRACT

A water-cooling heat dissipation system for LED signboard includes a frame, at least one water pipe system, and at least one water-cooling unit. At least one heat receiving section and at least one LED module in contact with one another are mounted to the frame. The water pipe system includes at least one water pipe extended through the heat receiving section. The water-cooling unit includes at least one water inlet and water outlet pipes, which are respectively connected to a front and a rear end of the water pipe system. The water-cooling unit drives a cooling liquid stored therein to circulate in between the water pipe system and the water-cooling unit, so that heat is quickly carried away from the heat receiving section by the cooling liquid to dissipate into surrounding environment. The water-cooling heat dissipation system has upgraded heat transfer efficiency to achieve good heat dissipation effect.

10 Claims, 12 Drawing Sheets

WATER-COOLING HEAT DISSIPATION SYSTEM FOR LED SIGNBOARD

FIELD OF THE INVENTION

The present invention relates to an LED signboard, and more particularly, to a water-cooling heat dissipation system for LED signboard, in which a water-cooling unit drives a cooling liquid to quickly flow and circulate in a water pipe system to thereby provide the LED signboard with effectively upgraded heat dissipation performance.

BACKGROUND OF THE INVENTION

Advertisements play a very important role in the highly competing commercial environment nowadays. For example, the establishment of a business image, the introduction of a company into market, the promotion of products, etc. all can be achieved through different types of advertisements. Eye-catching advertisements arouse people's curiosity and can be deeply impressed on people's memory. Therefore, most businesses pay high attention to their advertisement designs.

Among others, signboards designed with light emitting diodes (LED's) can show extremely good publicizing effect. An LED signboard turns a two-dimensional static presentation mode into a dynamic image presentation mode to show more changeful and flexible designs and visual effects that could not be achieved by other conventional advertising media.

However, LED modules forming the LED signboard would produce heat when they are used to emit light over a long period of time. In the event the produced heat is accumulated in the LED signboard without being timely removed, adverse influences on the LED signboard will occur. For example, the LED modules at different positions on the signboard might emit light of non-uniform brightness. In a worse condition, some of the LED modules might become burn-out or failed, resulting in discontinued advertising images on the signboard and accordingly largely reduced advertising effect.

To ensure the LED modules in the signboards to work and display high quality advertising images in a constant manner over an extended time period, the LED signboard manufacturers have to frequently dispatch workers to different districts to maintain and repair the LED signboards, which would inevitably increase the manufacturers' and the users' labor cost while the LED modules still have shortened service life.

In brief, the conventional LED signboards have the following disadvantages: (1) being subject to poor heat dissipation; (2) having shortened service life; (3) requiring high labor cost; and (4) showing non-uniform brightness.

It is therefore tried by the inventor to develop a water-cooling heat dissipation system for LED signboard to overcome the problems with the conventional LED signboards.

SUMMARY OF THE INVENTION

A primary object of the present invention is to provide a water-cooling heat dissipation system for LED signboard, which uses a water-cooling unit to circulate a cooling liquid in a water pipe system, so that heat produced by a plurality of LED modules of the LED signboard is carried away from the LED modules by the cooling liquid to effectively achieve good heat dissipation effect.

Another object of the present invention is to provide a water-cooling heat dissipation system for LED signboard, which uses heat pipes to quickly guide heat absorbed by a heat receiving section to nearby heat receiving sections and further to a frame for dissipating, so as to effectively achieve excellent heat dissipation effect.

A further object of the present invention is to provide a water-cooling heat dissipation system for LED signboard, which provides an increased heat dissipation area.

A still further object of the present invention is to provide a water-cooling heat dissipation system for LED signboard, which provides upgraded heat transfer efficiency.

A further object of the present invention is to provide a water-cooling heat dissipation system for LED signboard, which is able to extend the usable life of an LED signboard.

A further object of the present invention is to provide a water-cooling heat dissipation system for LED signboard, which enables LED modules of an LED signboard to maintain stable brightness.

To achieve the above and other objects, the water-cooling heat dissipation system for LED signboard according to the present invention includes a frame, at least one water pipe system, and at least one water-cooling unit. At least one heat receiving section and at least one LED module are mounted to the frame, and the heat receiving section(s) is (are) in contact with the LED module(s). The water pipe system includes at least one water pipe extended through the at least one heat receiving section. The water-cooling unit is connected to the water pipe system, and includes at least one water inlet pipe and at least one water outlet pipe, which are respectively connected to a front and a rear end of the water pipe system. The water-cooling unit drives a cooling liquid stored therein to circulate in between the water pipe system and the water-cooling unit, so that heat absorbed by the heat receiving section(s) is quickly carried away from the heat receiving section(s) by the cooling liquid to the water-cooling unit and dissipate into surrounding environment. Since the cooling liquid quickly guides the heat produced by the at least one LED module to the water-cooling unit for dissipating, the water-cooling heat dissipation system not only has upgraded heat transfer efficiency, but also allows the LED signboard to have good heat dissipation effect.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
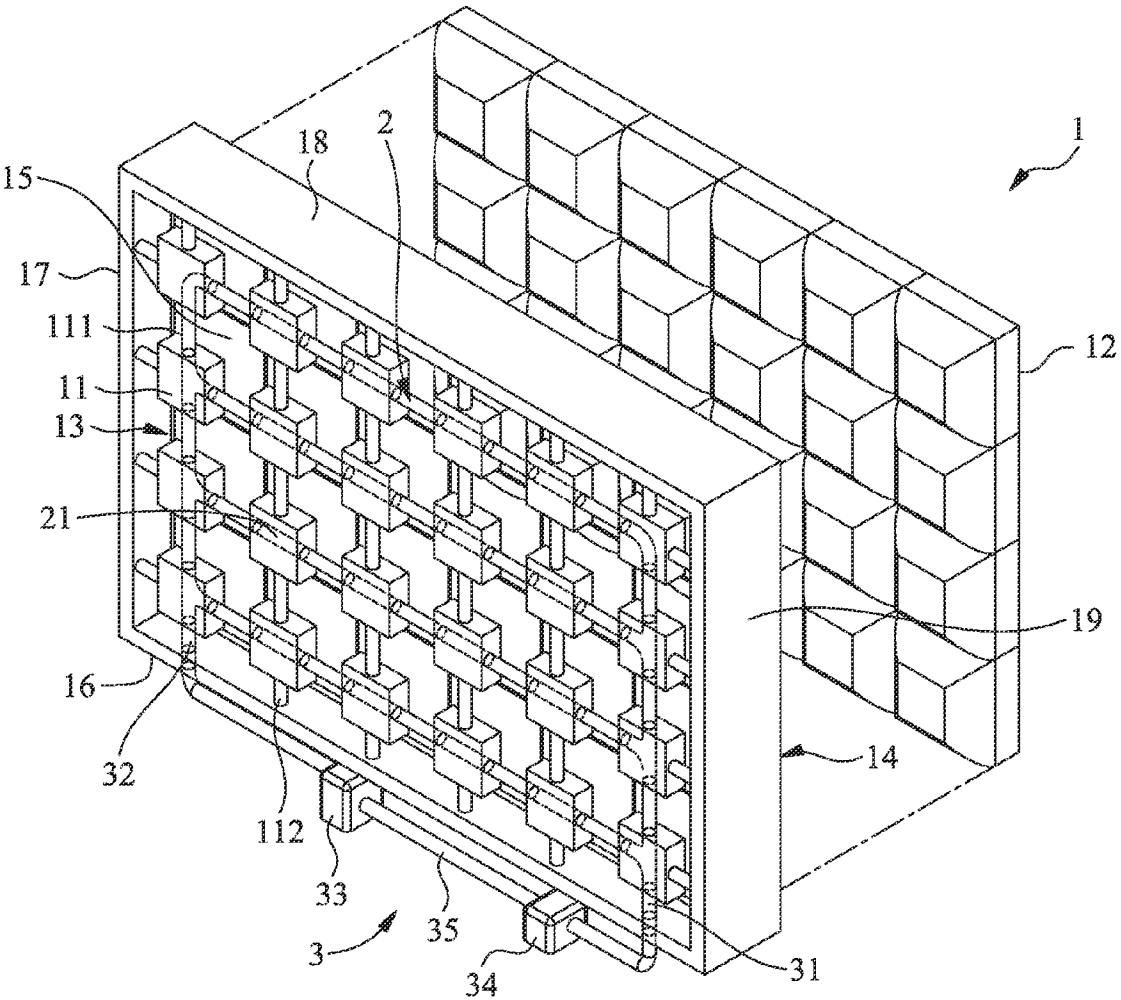
FIG. 1 is a rear exploded perspective view of a water-cooling heat dissipation system for LED signboard according to a first preferred embodiment of the present invention.
Figure 2:
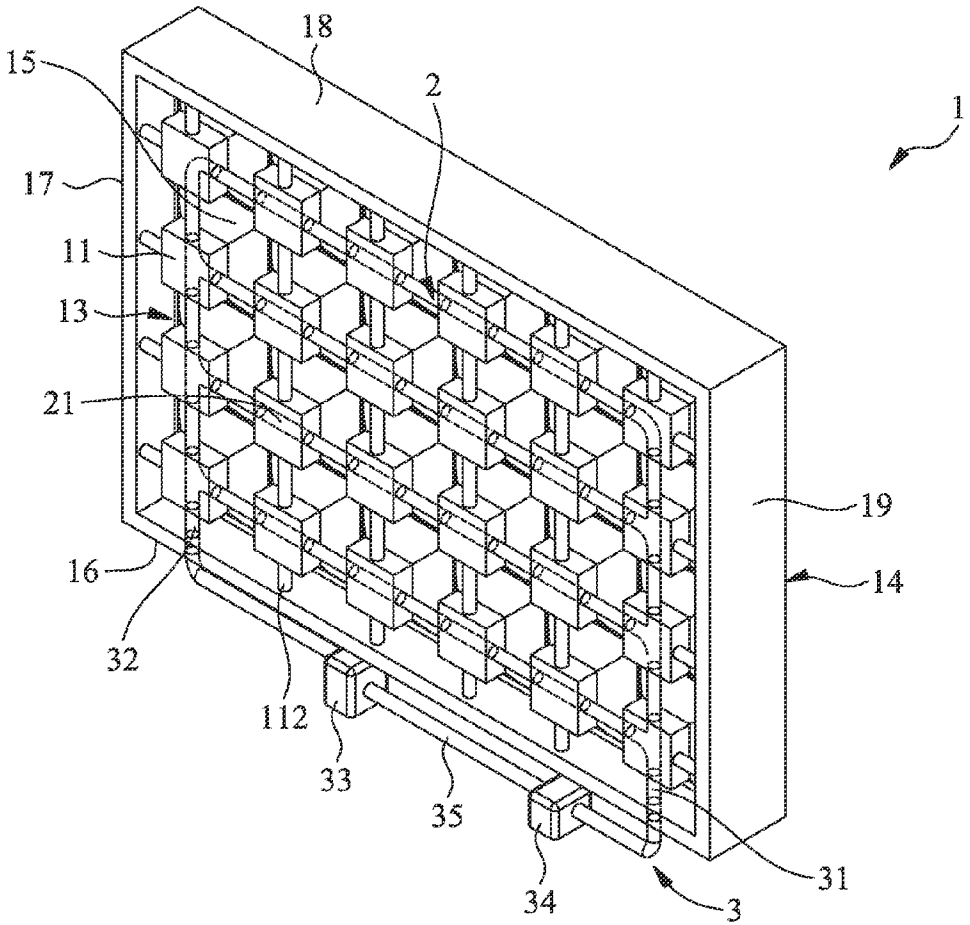
FIG. 2 is an assembled view of FIG. 1.
Figure 3:
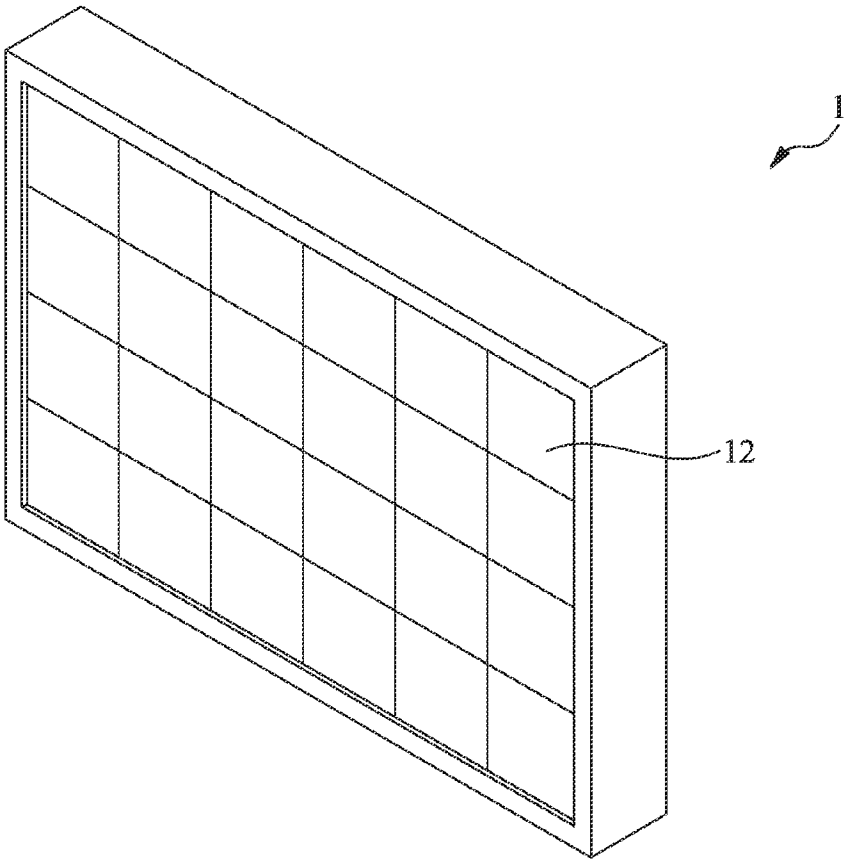
FIG. 3 is a front view of FIG. 2.
Figure 4:
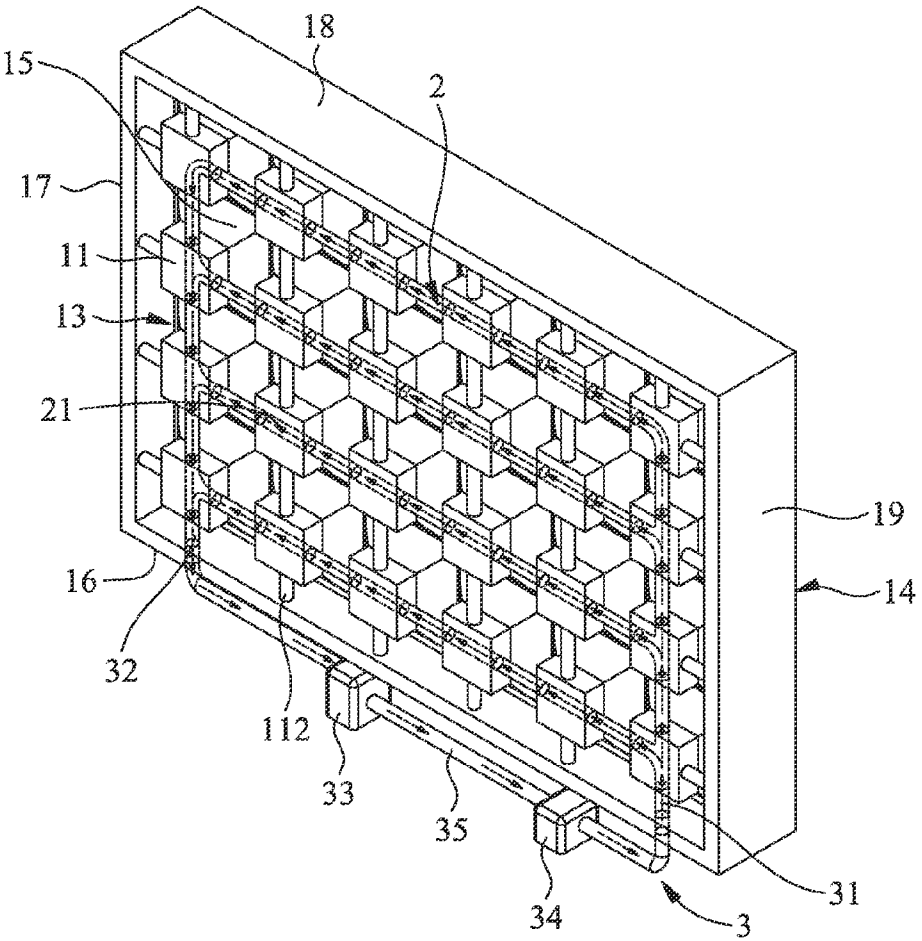
FIG. 4 shows the water-cooling heat dissipation system for LED signboard according to the first embodiment of the present invention in operation.
Figure 5:
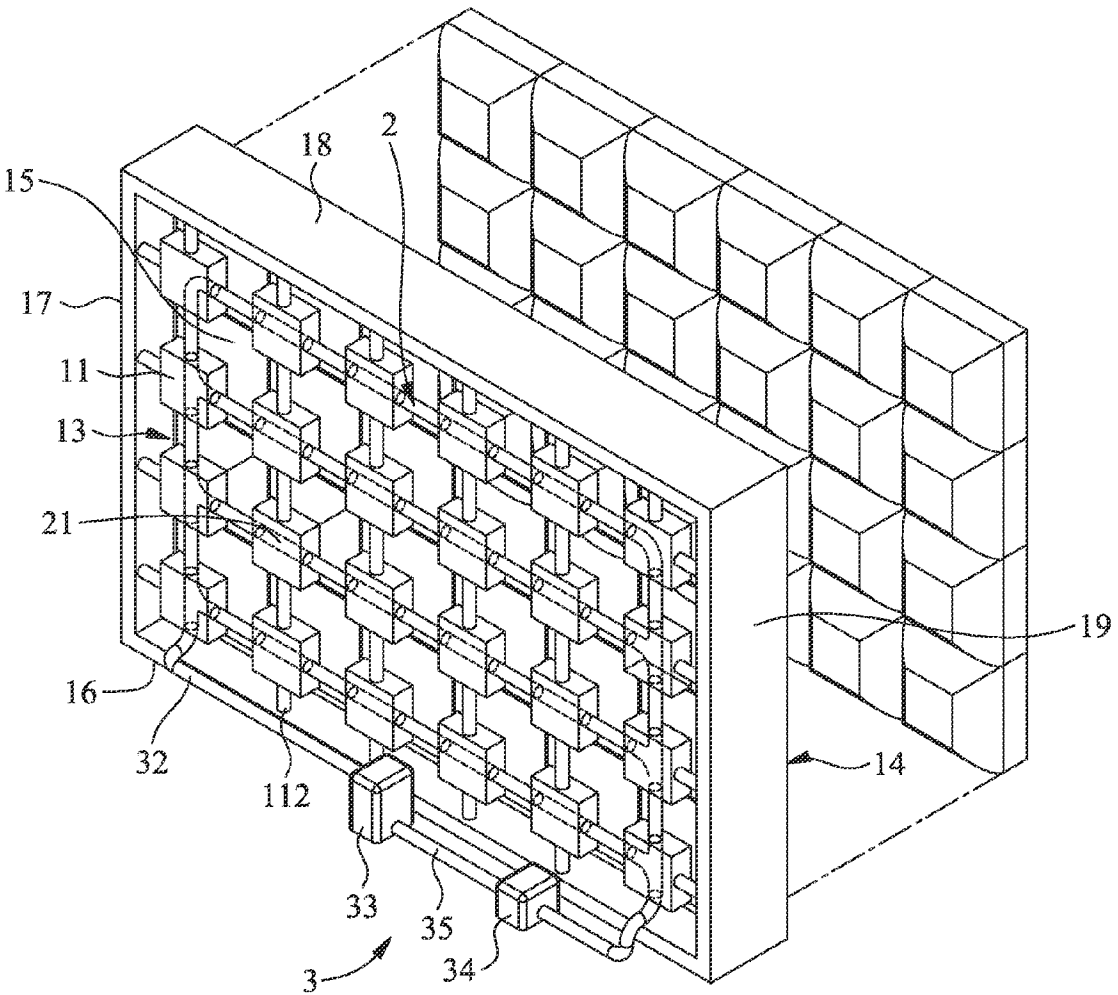
FIG. 5 is a rear exploded perspective view of a water-cooling heat dissipation system for LED signboard according to a second preferred embodiment of the present invention.
Figure 6:
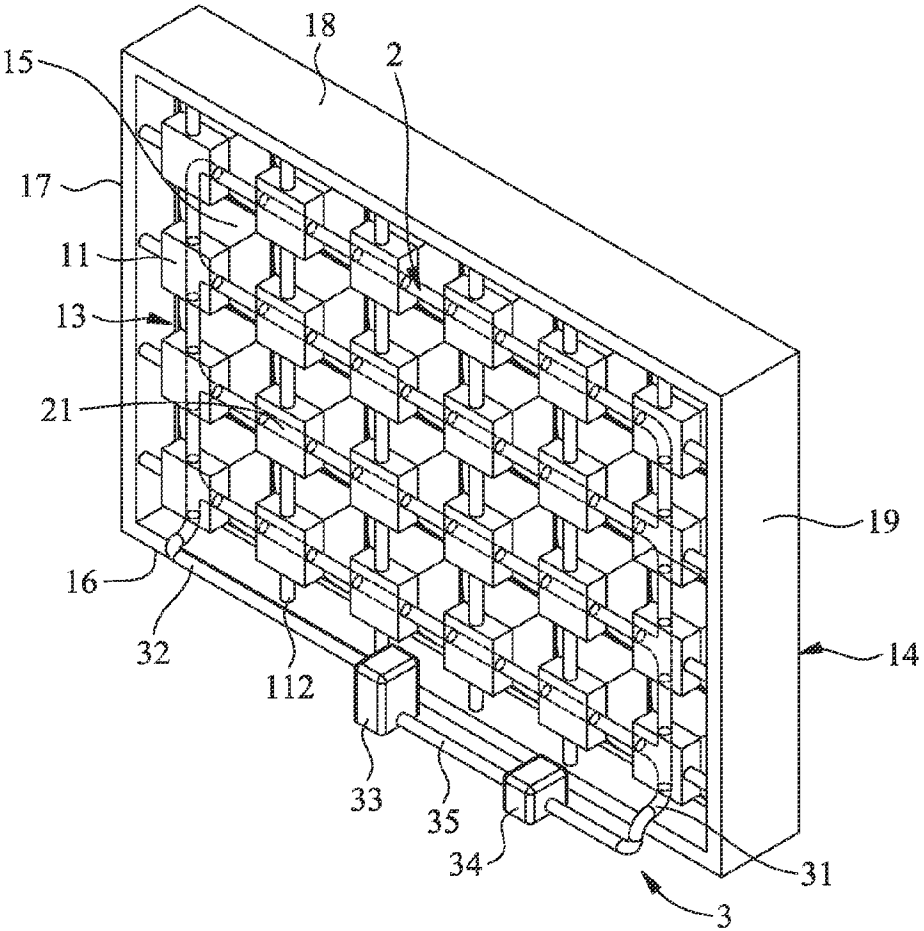
FIG. 6 is an assembled view of FIG. 5.
Figure 7:
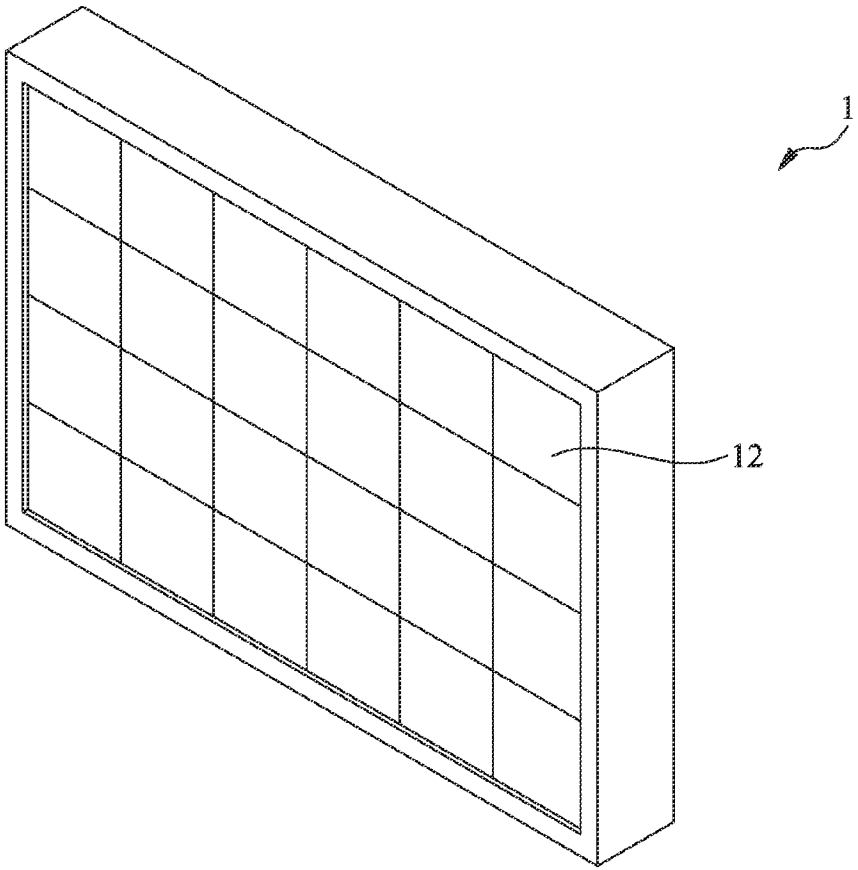
FIG. 7 is a front view of FIG. 6.
Figure 8:
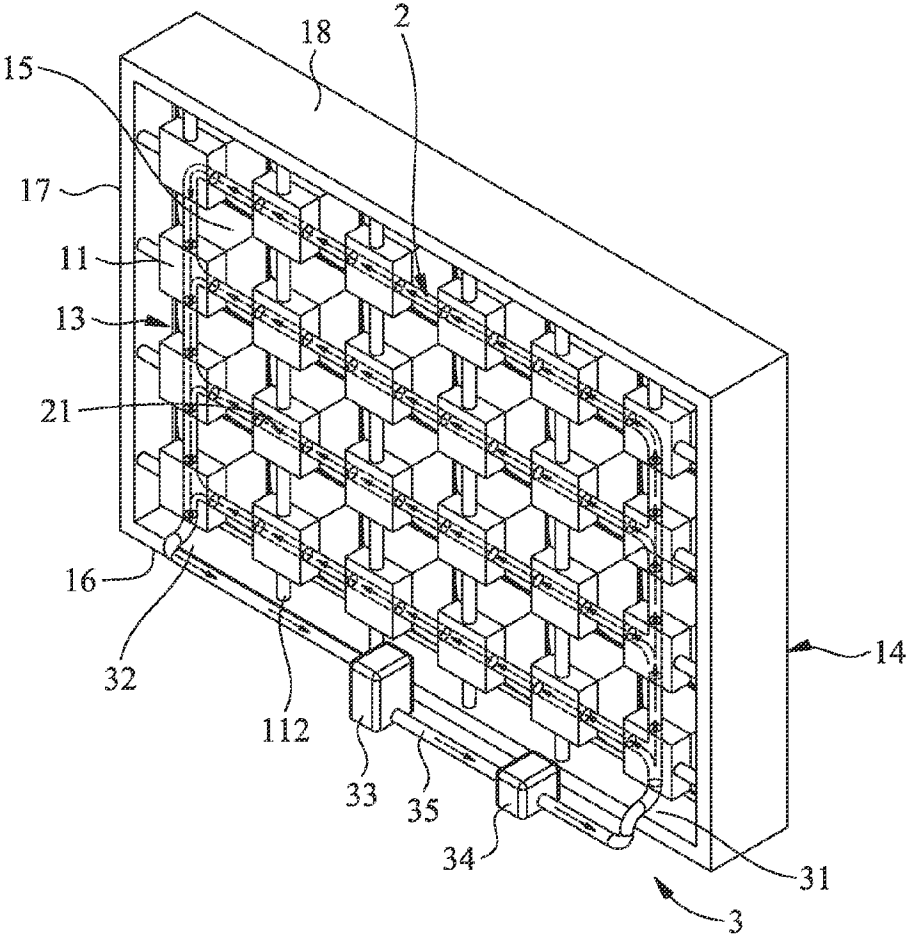
FIG. 8 shows the water-cooling heat dissipation system for LED signboard according to the second embodiment of the present invention in operation.

The present invention will now be described with some preferred embodiments thereof. For the purpose of easy to understand, elements that are the same in the preferred embodiments are denoted by the same reference numerals. It is also understood the embodiments and drawings are illustrated only for easy interpretation of the present invention without any intention of restricting the present invention.

Please refer to FIGS. 1 to 4, in which a water-cooling heat dissipation system for LED signboard according to a first preferred embodiment of the present invention is shown. As shown, the water-cooling heat dissipation system for LED signboard in the first embodiment includes a frame 1, at least one water pipe system 2, and at least one water-cooling unit 3. The frame 1 has at least one heat receiving section 11 and at least one LED module 12 mounted thereto. In the illustrated drawings, a plurality of heat receiving sections 11 and LED modules 12 is shown. The heat receiving sections 11 are bearing against the LED modules 12 in one-to-one correspondence. More particularly, the frame 1 has a mounting side 13 and a display side 14. A front side of the LED modules 12 facing away from the heat receiving sections 11 is flush with the display side 14 of the frame 1. The mounting side 13 and the display side 14 are corresponding to each other to define a receiving space 15 between them. The heat receiving sections 11 are made of a heat conductive material with good heat conducting or heat absorbing ability, and can therefore quickly absorb and transfer heat. The heat receiving sections 11 respectively have a contact side 111 being in tight contact with a back side of the LED modules 12.

The frame 1 includes a first sidewall 16, a second sidewall 17, a third sidewall 18, and a fourth sidewall 19. The first sidewall 16 is connected at two opposite ends to one end of the second sidewall 17 and the fourth sidewall 19, respectively, and the third sidewall 18 is connected at two opposite ends to an opposing end of the second sidewall 17 and the fourth sidewall 19, respectively, so that the first, second, third and fourth sidewalls are communicable with one another and extend around the receiving space 15. Two adjacent heat receiving sections 11 are connected to each other via a fixing element 112 extended between two facing sides of the adjacent heat receiving sections 11. The first, second, third and fourth sidewall 16, 17, 18 or 19 of the frame 1 are also connected to each of the heat receiving sections 11 adjacent thereto via a fixing element 112. Therefore, the heat receiving sections 11 are held in place relative to one another to locate in the receiving space 15 of the frame 1. Meanwhile, the heat receiving sections 11 are held to tightly contact at respective contact side 111 with the back side of the LED modules 12.

The at least one water pipe system 2 has at least one water pipe 21. In the illustrated drawings, there is shown one water pipe system 2 that has a plurality of water pipes 21. The water pipes 21 are extended through the heat receiving sections 11. The heat receiving sections 11 arranged in one row are simultaneously extended through by one single water pipe 21. The at least one water-cooling unit 3 is correspondingly connected to the at least one water pipe system 2 in the frame 1, and includes at least one water inlet pipe 31 and at least one water outlet pipe 32. In the illustrated drawings, there is shown one water-cooling unit 3 that has one water inlet pipe 31 and one water outlet pipe 32. The water inlet pipe 31 and the water outlet pipe 32 are separately communicably connected to all the water pipes 21. More particularly, the water inlet pipe 31 and the water outlet pipe 32 respectively have an end extended through the first sidewall 16 into the heat receiving sections 11 located adjacent thereto to respectively connect to a front and a rear end of the water pipe system 2. The water-cooling unit 3 further includes a pump 33 and a water tank 34. The pump 33 and the water tank 34 have a cooling liquid stored therein. And, the pump 33 and the water tank 34 are communicably connected to each other by a connecting pipe 35. The water inlet pipe 31 is connected at an opposing end to the water tank 34, and the water outlet pipe 32 is connected at an opposing end to the pump 33. The pump 33 drives the cooling liquid stored therein to circulate in between the water pipe system 2 and the water-cooling unit 3 to achieve the purpose of carrying heat away from the heat receiving sections 11.

When the cooling liquid in the water tank 34 is driven by the pump 33 to flow out of the water tank 34 into the frame 1 via the water inlet pipe 31, the cooling liquid further flows into the water pipes 21 that are extended through the heat receiving sections 11, so that heat absorbed by the heat receiving sections 11 from the LED modules 12 is carried by the cooling liquid away from the heat receiving sections 11. The cooling liquid carrying the heat then flows back to the water tank 34 via the water outlet pipe 32. In this manner, the cooling liquid keeps circulating in between the water pipe system 2 and the water-cooling unit 3 to carry heat away from the heat receiving sections 11 to provide effectively upgraded heat dissipation efficiency and quickly remove the heat. All the heat receiving sections 11 attaching to the back side of the LED modules 12 are extended through either by the water pipes 21, the water inlet pipe 31 or the water outlet pipe 32 while the water inlet pipe 31 and the water outlet pipe 32 are communicably connected to the water pipes 21, so that a circulation loop is formed. Further, since the fixing elements 112 between the adjacent heat receiving sections 11 and between the frame 1 and the heat receiving sections 11 adjacent thereto are made of a heat conductive material, such as heat pipes, heat produced by the LED modules 12 and absorbed by the heat receiving sections 11 can also be transferred from the heat receiving sections 11 via the fixing elements 112 to the frame 1, which is also made of a heat conductive material. Thus, with the water-cooling heat dissipation system for LED signboard according to the present invention, the heat produced by the LED modules 12 can be not only carried away by the circulating cooling liquid, but also effectively transferred via the heat-conducting fixing elements 112 to the frame 1 for dissipation therefrom. Therefore, effectively upgraded heat dissipation efficiency can be achieved to remove heat quickly.

FIGS. 5 to 8 illustrate a water-cooling heat dissipation system for LED signboard according to a second preferred embodiment of the present invention. In the second embodiment, the water-cooling heat dissipation system for LED signboard includes a frame 1, at least one water pipe system 2, and at least one water-cooling unit 3. The frame 1 has at least one heat receiving section 11 and at least one LED module 12 mounted thereto. In the illustrated drawings, a plurality of heat receiving sections 11 and LED modules 12 is shown. The heat receiving sections 11 are bearing against the LED modules 12 in one-to-one correspondence. More particularly, the frame 1 has a mounting side 13 and a display side 14. A front side of the LED module 12 facing away from the heat receiving sections 11 is flush with the display side 14 of the frame 1. The mounting side 13 and the display side 14 are corresponding to each other to define a receiving space 15 between them. The heat receiving sections 11 are made of a heat conductive material with good heat conducting or heat absorbing ability, and can therefore quickly absorb and transfer heat. The heat receiving sections 11 respectively have a contact side 111 being in tight contact with a back side of the LED modules 12. The frame 1 includes a first sidewall 16, a second sidewall 17, a third sidewall 18, and a fourth sidewall 19. The first, second, third and fourth sidewall 16, 17, 18 or 19 of the frame 1 are connected to each of the heat receiving sections 11 adjacent thereto via a fixing element 112. Therefore, the heat receiving sections 11 are held in place relative to one another to locate in the receiving space 15 of the frame 1. Meanwhile, the heat receiving sections 11 are held to tightly contact at respective contact side 111 with the back side of the LED modules 12.

The at least one water pipe system 2 has at least one water pipe 21. In the illustrated drawings, there is shown one water pipe system 2 that has a plurality of water pipes 21. The water pipes 21 are extended through the heat receiving sections 11. The at least one water-cooling unit 3 is arranged in the frame 1 and correspondingly connected to the at least one water pipe system 2 in the frame 1, and includes at least one water inlet pipe 31 and at least one water outlet pipe 32. In the illustrated drawings, there is shown one water-cooling unit 3 that has one water inlet pipe 31 and one water outlet pipe 32. The water inlet pipe 31 and the water outlet pipe 32 are separately communicably connected to all the water pipes 21, and have an end connect to a front and a rear end of the water pipe system 2, respectively. The water-cooling unit 3 further includes a pump 33 and a water tank 34. The water inlet pipe 31 is connected at an opposing end to the water tank 34, and the water outlet pipe 32 is connected at an opposing end to the pump 33. The pump 33 drives a cooling liquid stored therein to circulate in between the water pipe system 2 and the water-cooling unit 3 to achieve the purpose of carrying heat away from the heat receiving sections 11.

When the cooling liquid in the water tank 34 is driven by the pump 33 to flow out of the water tank 34 into the frame 1 via the water inlet pipe 31, the cooling liquid further flows into the water pipes 21 that are extended through the heat receiving sections 11, so that heat absorbed by the heat receiving sections 11 from the LED modules 12 is carried by the cooling liquid away from the heat receiving sections 11. The cooling liquid carrying the heat then flows back to the water tank 34 via the water outlet pipe 32. In this manner, the cooling liquid keeps circulating in between the water pipe system 2 and the water-cooling unit 3 to carry heat away from the heat receiving sections 11 to provide effectively upgraded heat dissipation efficiency and quickly remove the heat.

Figure 9:
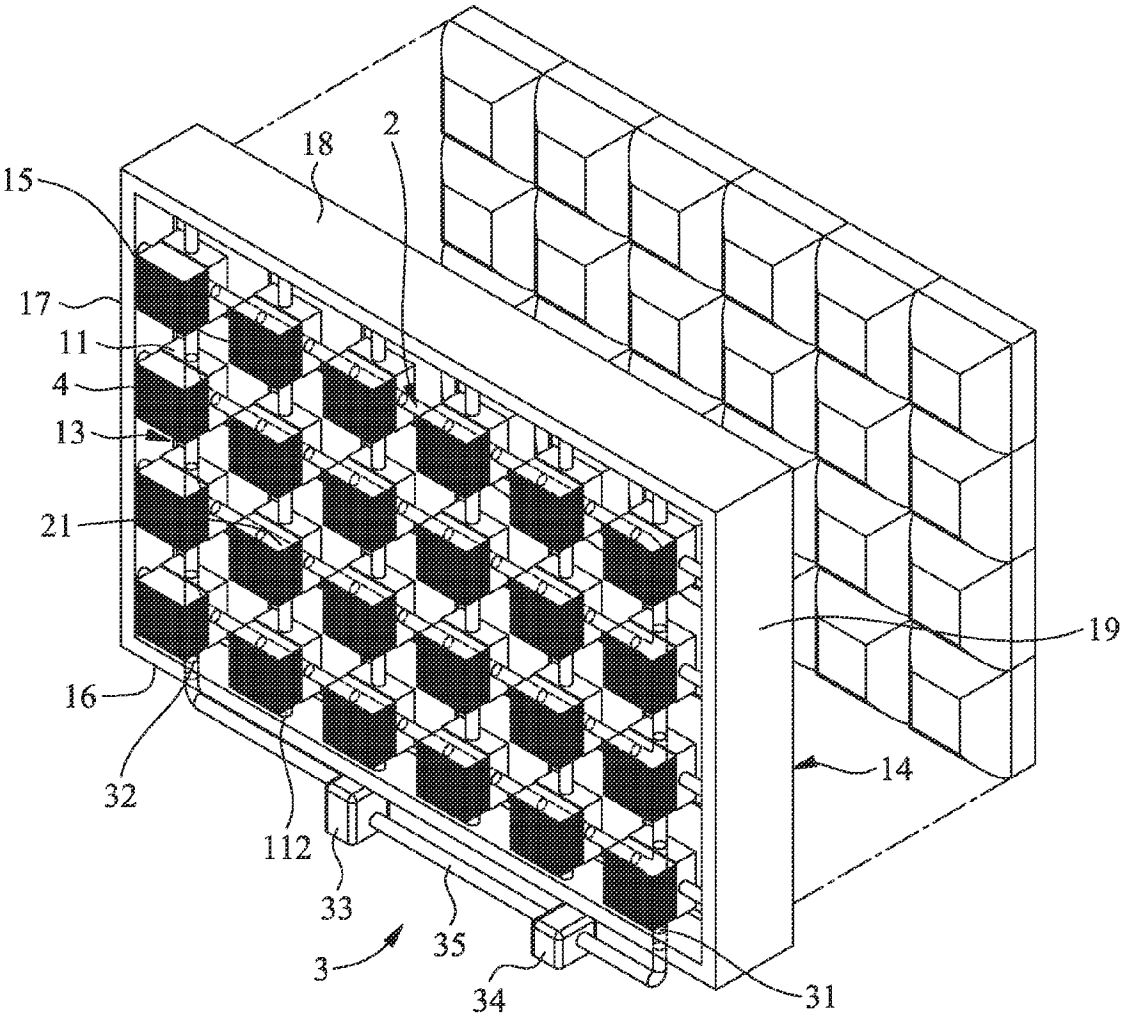
FIG. 9 is a rear exploded perspective view of a water-cooling heat dissipation system for LED signboard according to a third preferred embodiment of the present invention.
Figure 10:
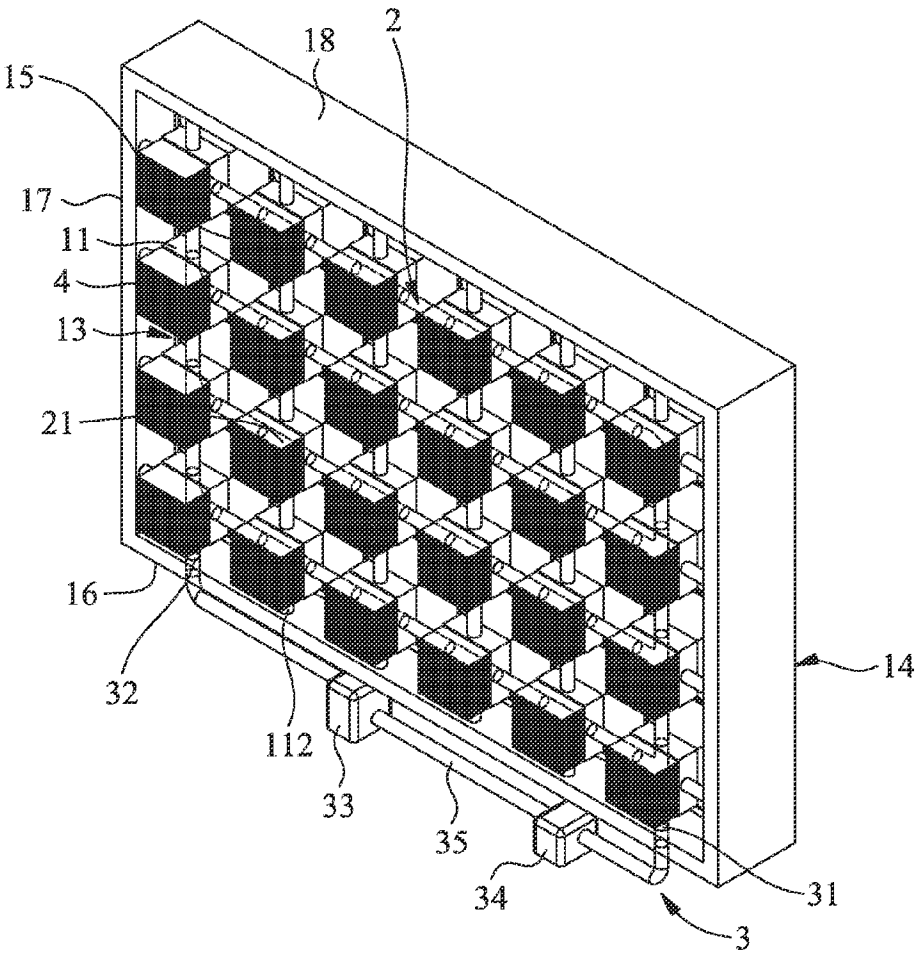
FIG. 10 is an assembled view of FIG. 9.
Figure 11:
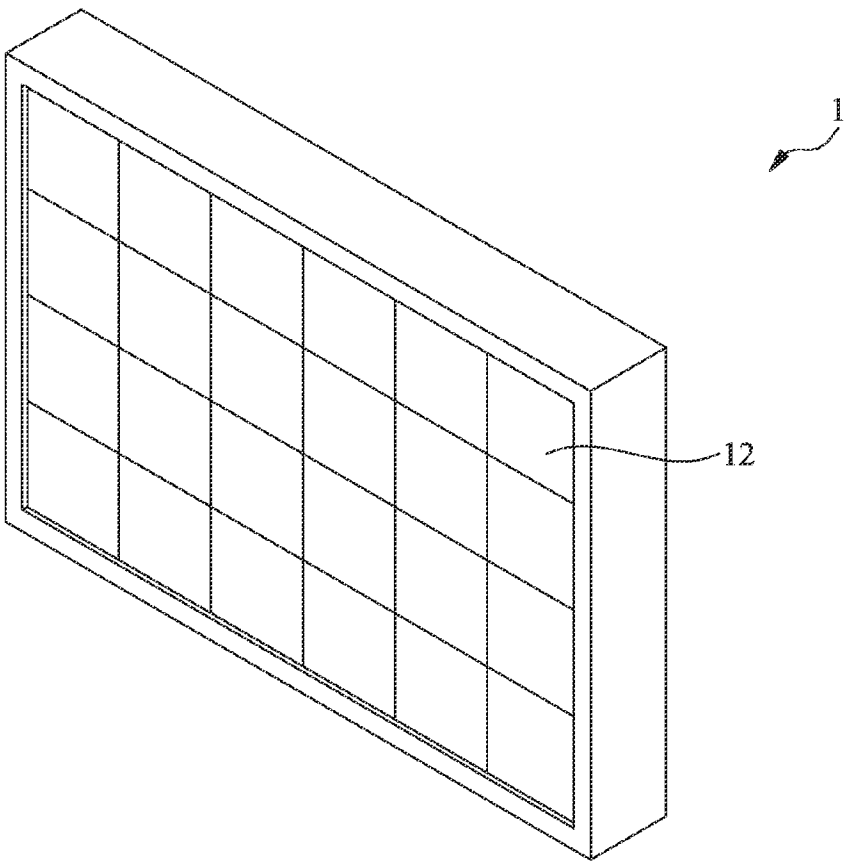
FIG. 11 is a front view of FIG. 10.
Figure 12:
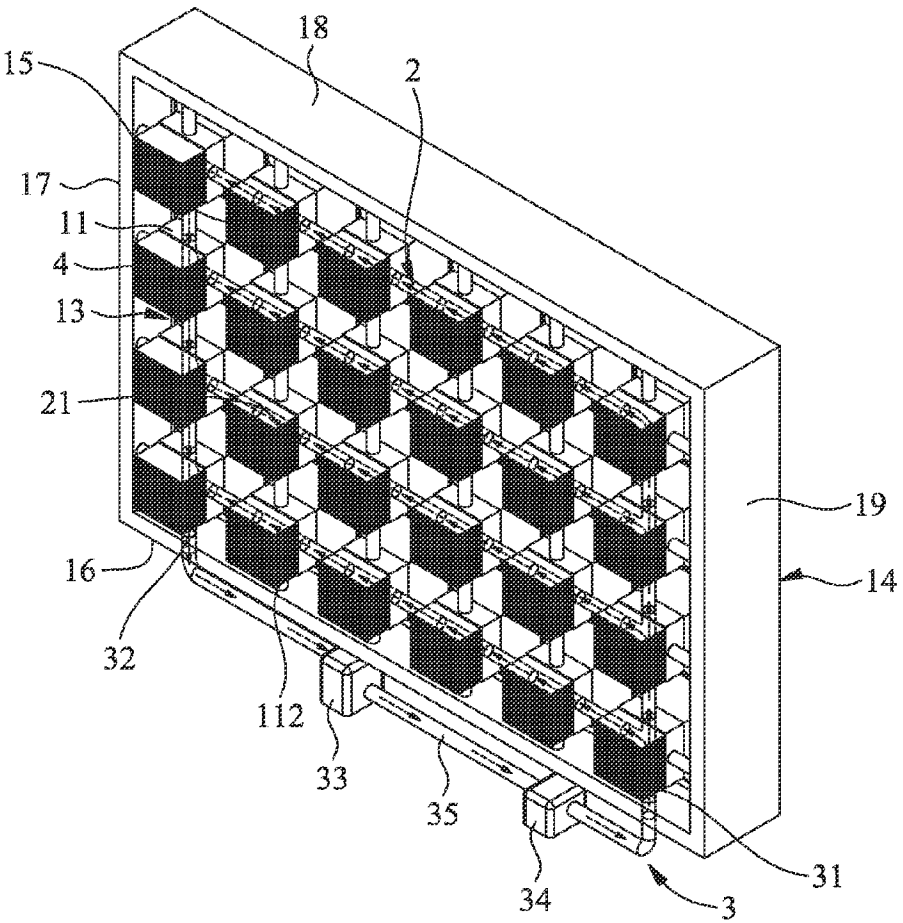
FIG. 12 shows the water-cooling heat dissipation system for LED signboard according to the third embodiment of the present invention in operation.

FIGS. 9 to 10 illustrate a water-cooling heat dissipation system for LED signboard according to a third preferred embodiment of the present invention. In the third embodiment, the water-cooling heat dissipation system for LED signboard includes a frame 1, at least one water pipe system 2, and at least one water-cooling unit 3. The frame 1 has at least one heat receiving section 11 and at least one LED module 12 mounted thereto. In the illustrated drawings, a plurality of heat receiving sections 11 and LED modules 12 is shown. The heat receiving sections 11 are bearing against the LED module 12 in one-to-one correspondence. More particularly, the frame 1 has a mounting side 13 and a display side 14. A front side of the LED modules 12 facing away from the heat receiving sections 11 is flush with the display side 14 of the frame 1. The mounting side 13 and the display side 14 are corresponding to each other to define a receiving space 15 between them. The heat receiving sections 11 are made of a heat conductive material with good heat conducting or heat absorbing ability, and can therefore quickly absorb and transfer heat. The frame 1 includes a first sidewall 16, a second sidewall 17, a third sidewall 18, and a fourth sidewall 19. The first, second, third and fourth sidewall 16, 17, 18 or 19 of the frame 1 are connected to each of the heat receiving sections 11 adjacent thereto via a fixing element 112. Therefore, the heat receiving sections 11 are held in place relative to one another to locate in the receiving space 15 of the frame 1. Meanwhile, the heat receiving sections 11 are held to tightly contact at respective contact side 111 with the back side of the LED modules 12.

The at least one water pipe system 2 has at least one water pipe 21. In the illustrated drawings, there is shown one water pipe system 2 that has a plurality of water pipes 21. The water pipes 21 are extended through the heat receiving sections 11. The at least one water-cooling unit 3 is correspondingly connected to the at least one water pipe system 2 in the frame 1, and includes at least one water inlet pipe 31 and at least one water outlet pipe 32. In the illustrated drawings, there is shown one water-cooling unit 3 that has one water inlet pipe 31 and one water outlet pipe 32. The water inlet pipe 31 and the water outlet pipe 32 are separately communicably connected to all the water pipes 21, and have an end connect to a front and a rear end of the water pipe system 2, respectively. The water-cooling unit 3 further includes a pump 33 and a water tank 34. The water inlet pipe 31 is connected at an opposing end to the water tank 34, and the water outlet pipe 32 is connected at an opposing end to the pump 33. The pump 33 drives a cooling liquid stored therein to circulate in between the water pipe system 2 and the water-cooling unit 3 to achieve the purpose of carrying heat away from the heat receiving sections 11.

The heat receiving sections 11 respectively have one side bearing against a back side of the LED modules 12, and are respectively provided on another side facing away from the LED modules 12 with a plurality of radiating fins 4. When the cooling liquid in the water tank 34 is driven by the pump 33 to flow out of the water tank 34 into the frame 1 via the water inlet pipe 31, the cooling liquid further flows into the water pipes 21 that are extended through the heat receiving sections 11, so that heat absorbed by the heat receiving sections 11 from the LED modules 12 is carried by the cooling liquid away from the heat receiving sections 11. The cooling liquid carrying the heat then flows back to the water tank 34 via the water outlet pipe 32. In this manner, the cooling liquid keeps circulating in between the water pipe system 2 and the water-cooling unit 3 to carry heat away from the heat receiving sections 11 to provide effectively upgraded heat dissipation efficiency and quickly remove the heat. Meanwhile, the heat produced by the LED modules 12 and absorbed by the heat receiving sections 11 is also transferred via the fixing elements 112 to the frame 1, which is also made of a heat conductive material. Thus, with the water-cooling heat dissipation system for LED signboard according to the present invention, the heat produced by the LED modules 12 can be not only carried away by the circulating cooling liquid, but also effectively transferred via the heat-conducting fixing elements 112 to the frame 1 for dissipation therefrom. Therefore, effectively upgraded heat dissipation efficiency can be achieved to remove heat quickly. Moreover, in the third preferred embodiment, the heat absorbed by the heat receiving sections 11 can also be radiated from the radiating fins 4 provided on one side of the heat receiving sections 11 to thereby achieve further upgraded heat dissipation efficiency and more quickly remove the heat.

In brief, the water-cooling heat dissipation system for LED signboard according to the present invention has the following advantages: (1) having excellent heat dissipation effect; (2) providing an increased heat radiating area; (3) upgrading heat transfer efficiency; (4) having extended service life; and (5) enabling the LED module to emit light having uniform brightness.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A water-cooling heat dissipation system for LED signboard, comprising:

a frame comprising a first sidewall, a second sidewall, a third sidewall and a fourth sidewall, the frame connected to a plurality of heat receiving sections; and a plurality of LED modules mounted to the plurality of heat receiving sections, respectively; the plurality of heat receiving sections being in contact with the plurality of LED modules in one-to-one correspondence;

at least one water pipe system having at least one water pipe, and the at least one water pipe being extended through at least one heat receiving section;

at least one water-cooling unit being correspondingly connected to the at least one water pipe system, and including at least one water inlet pipe and at least one water outlet pipe; the water inlet pipe and the water outlet pipe being connected to a front end and a rear end of the water pipe system, respectively, and the water-cooling unit driving a cooling liquid stored therein to circulate in between the water pipe system and the water-cooling unit to carry heat away from the at least one heat receiving section;

wherein the sidewalls of the frame are connected via fixing elements to the heat receiving sections adjacent the sidewalls;

wherein any two adjacent heat receiving sections are connected to each other via a fixing element; and wherein the fixing elements are heat pipes for transferring heat from one heat receiving section to other heat receiving sections adjacent thereto and from heat receiving sections adjacent the sidewalls of the frame to the frame, from which the heat is dissipated into surrounding environment.

2. The water-cooling heat dissipation system for LED signboard as claimed in claim 1, wherein the water-cooling unit further includes a pump and a water tank for storing the cooling liquid therein, and the water inlet pipe being connected at an end to the water tank and the water outlet pipe being connected at an end to the pump.

3. The water-cooling heat dissipation system for LED signboard as claimed in claim 2, wherein the pump and the water tank is connected to and communicable with each other via a connecting pipe extended between them.

4. The water-cooling heat dissipation system for LED signboard as claimed in claim 1, wherein the frame has a mounting side and a display side; one side of the LED modules facing away from the heat receiving sections being flush with the display side of the frame; the mounting side and the display side being corresponding to each other to define a receiving space between them; and the heat receiving sections and the LED modules being received in the receiving space.

5. The water-cooling heat dissipation system for LED signboard as claimed in claim 4, wherein the at least one water-cooling unit is received in the receiving space.

6. The water-cooling heat dissipation system for LED signboard as claimed in claim 1, wherein each heat receiving section is a heat radiating element made of a copper material; and the copper heat radiating element having a contact side in tight contact with the respective LED module.

7. The water-cooling heat dissipation system for LED signboard as claimed in claim 4, wherein the first sidewall being connected at two opposite ends to one end of the second and the fourth sidewall, respectively, and the third sidewall being connected at two opposite ends to an opposing end of the second and the fourth sidewall, respectively, so that the first, second, third and fourth sidewalls are communicable with one another and extend around the receiving space; and the heat pipes transfer heat to the first, the second, the third and the fourth sidewall, so that the heat is dissipated from the four sidewalls into surrounding environment.

8. The water-cooling heat dissipation system for LED signboard as claimed in claim 7, wherein the water-cooling unit is located outside the frame, and the water inlet pipe being inward extended through one of the first, the second, the third and the fourth sidewall.

9. The water-cooling heat dissipation system for LED signboard as claimed in claim 7, wherein the water-cooling unit is located outside the frame, and the water outlet pipe being outward extended through one of the first, the second, the third and the fourth sidewall.

10. The water-cooling heat dissipation system for LED signboard as claimed in claim 1, wherein at least one heat receiving section is further externally provided on one side facing away from the respective LED module with a plurality of radiating fins.

* * * * *